US008238787B2

(12) United States Patent
Tani

(10) Patent No.: US 8,238,787 B2
(45) Date of Patent: Aug. 7, 2012

(54) PROCESS CARTRIDGE AND ELECTROPHOTOGRAPHIC IMAGE FORMING APPARATUS

(75) Inventor: Sadaaki Tani, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 12/699,438

(22) Filed: Feb. 3, 2010

(65) Prior Publication Data

US 2010/0209138 A1 Aug. 19, 2010

(30) Foreign Application Priority Data

Feb. 16, 2009 (JP) ..... 2009-032821

(51) Int. Cl.
*G03G 21/16* (2006.01)

(52) U.S. Cl. ..... 399/111

(58) Field of Classification Search ..... 399/110, 399/111, 113, 116, 119
See application file for complete search history.

(56) References Cited

U.S. PATENT DOCUMENTS 8,086,135 B2 * 12/2011 Hashimoto ..... 399/111
2002/0110386 A1 * 8/2002 Kanno et al. ..... 399/111
2008/0138106 A1 * 6/2008 Kanno et al. ..... 399/111
2008/0138107 A1 6/2008 Mori et al.
2010/0158565 A1 * 6/2010 Kanno et al. ..... 399/113
2011/0123224 A1 * 5/2011 Chadani et al. ..... 399/111
2011/0229196 A1 * 9/2011 Kawai et al. ..... 399/111
2011/0268473 A1 * 11/2011 Hashimoto ..... 399/111
2011/0299882 A1 * 12/2011 Tanaami et al. ..... 399/110
2012/0003002 A1 * 1/2012 Hashimoto ..... 399/111
2012/0063810 A1 * 3/2012 Chadani et al. ..... 399/111

* cited by examiner

*Primary Examiner* — Robert Beatty
(74) *Attorney, Agent, or Firm* — Fitzpatrick, Cella, Harper & Scinto

(57) ABSTRACT

At a lower portion of a process cartridge, a first portion to be urged and a second portion to be urged are provided. To an image forming apparatus, a guide portion for slidably guiding the first portion to be urged and the second portion to be urged during mounting of the process cartridge in the image forming apparatus is provided. Further, to the guide portion is provided with a first hole and a second hole at two recessed portions with respect to a longitudinal and mounting direction of the process cartridge. At bottoms of the two recessed portions wherein the first hole and the second hole are provided, a first urging portion acting on the first portion to be urged and a second urging portion acting on the second portion to be urged are provided, respectively. The second portion to be urged has a dimension larger than that of the first hole with respect to the mounting direction.

8 Claims, 10 Drawing Sheets

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus using the process cartridge.

Here, an electrophotographic image forming apparatus refers to an apparatus which forms an image on recording material (medium) with the use of electrophotographic image forming method. As the example of an electrophotographic image forming apparatus, an electrophotographic copying machine, an electrophotographic printer (for example, laser beam printer, LED printer, etc.), a facsimile machine, a word processor, etc., may be included.

Further, the process cartridge refers to a cartridge in which at least a developing means as a process means and an electrophotographic photosensitive member are integrally supported, and which is detachably mountable to a main assembly of an electrophotographic image forming apparatus.

In the electrophotographic image forming apparatus using an electrophotographic image forming process, a process cartridge system, in which an electrophotographic photosensitive drum and processing means acting on the electrophotographic photosensitive drum are integrally supported in a cartridge which is detachably mountable to the main assembly of the electrophotographic image forming apparatus, has been conventionally employed. According to this process cartridge system, it is possible for a user to perform maintenance of the apparatus by himself (herself) without relying on a service person, so that operativity can be significantly improved. Therefore, the process cartridge system is widely in used in the electrophotographic image forming apparatus.

An apparatus constitution in which such a process cartridge is mounted to the image forming apparatus along an axial direction of the photosensitive drum has been known.

Further, after the process cartridge was mounted to the image forming apparatus, the electrophotographic photosensitive drum and a developing roller which was the process means acting on the photosensitive drum were left standing in a contact state, so that the developing roller was deformed by a contact pressure thereof with respect to the photosensitive drum in some cases. With respect to this deformation, a measure has been taken by optimizing a material of the developing roller. However, in order to further stabilize an image quality, it is desirable that the photosensitive drum and the developing roller are kept in a mutually separated state.

Therefore, in such a mounting constitution that the process cartridge is mounted to the image forming apparatus along the axial direction of the photosensitive drum, a contact and separation constitution for moving the developing roller toward and away from the photosensitive drum has been known (U.S. Patent Application Publication No. US2008/0138107).

A constitution which is under further development of the above-described constitution and is unknown is shown in FIGS. 9 and 10. First, a process cartridge 1 through shafts 27R and 27L. Then, a portion to be urged 30 (30*a*, 30*b*) for separating a developing roller 21 from a photosensitive drum 11 by receiving an acting force from the image forming apparatus is provided at a part of the developing unit 20. When the process cartridge 1 is mounted, the portion to be urged 30 (30*a*, 30*b*) is urged (pressed) by a guide member 102 provided to the image forming apparatus, so that the developing roller 21 is moved away from the photosensitive drum 11.

In this constitution, a hole 103 (103*a*, 103*b*) is formed at a part of a guide surface 102*b* of the guide member 102 along which the portion to be urged 30 (30*a*, 30*b*) slides, and an urging portion 104 (104*a*, 104*b*) actable on the portion to be urged 30 (30*a*, 30*b*) is provided at the bottom of the hole 103 (103*a*, 103*b*). As a result, in a state in which the process cartridge 1 is mounted to the image forming apparatus, the photosensitive drum 11 and the developing roller 21 are kept in a separated state. Further, the guide surface 102*b* of the guide member 102 is made higher than the urging portion 104, whereby the urging portion 104 is prevented from being abraded by friction during the mounting of the process cartridge 1 to stabilize an amount of separation (spacing) of the developing roller 21.

The mounting operation of the process cartridge 1 in the above-described constitution will be described with reference to FIGS. 10(*a*) to 10(*d*). The process cartridge 1 is mounted to the image forming apparatus with respect to an arrow Z direction indicated in FIG. 10(*a*). At this time, the portion to be urged 30*b* is moved in an arrow Y direction along a tapered portion 102*a* provided to the guide member 102 (FIGS. 10 (*a*) and 10(*b*)).

However, in the above-described constitution, when the mounting operation is further continued, the portion to be urged 30*b* of the process cartridge 1 engages into the hole 103*a* provided to the guide member 102 as shown in FIG. 10(*c*). Thereafter, by continuing the mounting, as shown in FIG. 10(*d*), the portion to be urged 30*b* runs from the hole 103*a* onto a guide surface 102*b* as shown in FIG. 10(*d*) (arrow X). At this time, there was a possibility of an increase in mounting load of the process cartridge 1.

The present invention further develops the above-described constitution.

As described above, in the constitution shown in FIGS. 10(*a*) to 10(*d*), in the mounting process of the process cartridge 1, the mounting load was temporarily increased, so that a feeding of smooth mounting was not obtained in some cases.

SUMMARY OF THE INVENTION

A principal object of the present invention is to provide a process cartridge improved in operativity when the process cartridge is mounted to an apparatus main assembly.

Another object of the present invention is to provide an electrophotographic image forming apparatus using the process cartridge.

According to an aspect of the present invention, there is provided an electrophotographic image forming apparatus comprising:

a process cartridge comprising a photosensitive member unit which includes an electrophotographic photosensitive member and comprising a developing unit which includes a developing roller for developing an electrostatic latent image formed on the electrophotographic photosensitive member and which is movable toward and away from the photosensitive member unit in order that the electrophotographic photosensitive member and the developing roller can be moved toward and away from each other; and a main assembly of the electrophotographic image forming apparatus to which the process cartridge is mountable along a longitudinal direction of the electrophotographic photosensitive member, wherein (a) the developing unit includes a first portion to be urged provided on an upstream side with respect to a mounting direction of the process cartridge and includes a second portion to be urged provided on a downstream side with respect to the mounting direction, wherein (b) the main assembly comprises:

a guide portion for guiding the first portion to be urged and the second portion to be urged during mounting of the process cartridge in the main assembly, wherein the guide portion includes, in a state in which the process cartridge is mounted in the main assembly, a first hole for permitting thereinto entry of the first portion to be urged and a second hole for permitting thereinto entry of the second portion to be urged;

a first urging portion for urging the first portion to be urged, in a state in which the first member to be urged enters the first hole, so as to move the developing unit with respect to the photosensitive member unit; and a second urging portion for urging the second portion to be urged, in a state in which the second member to be urged enters the second hole, so as to move the developing unit with respect to the photosensitive member unit, and wherein (c) the second portion to be urged is non-enterable into the first hole.

According to another aspect of the present invention, there is provided an electrophotographic image forming apparatus comprising:

a process cartridge comprising a photosensitive member unit which includes an electrophotographic photosensitive member and comprising a developing unit which includes a developing roller for developing an electrostatic latent image formed on the electrophotographic photosensitive member and which is movable toward and away from the photosensitive member unit in order that the electrophotographic photosensitive member and the developing roller can be moved toward and away from each other; and a main assembly of the electrophotographic image forming apparatus to which the process cartridge is mountable along a longitudinal direction of the electrophotographic photosensitive member, wherein (a) the main assembly includes a first urging portion provided on an upstream side with respect to a mounting direction of the process cartridge and includes a second urging portion provided on a downstream side with respect to the mounting direction, wherein (b) the developing unit comprises:

a portion to be guided for being guided by the first urging portion and the second urging portion during mounting of the process cartridge in the main assembly, wherein the portion to be guided includes, in a state in which the process cartridge is mounted in the main assembly, a first hole for permitting thereinto entry of the first urging portion and a second hole for permitting thereinto entry of the second urging portion;

a first portion to be urged for being urged by the first urging portion, in a state in which the first member to be urged enters the first hole, so as to move the developing unit with respect to the photosensitive member unit; and a second portion to be urged for being urged by the second urging portion, in a state in which the second member to be urged enters the second hole, so as to move the developing unit with respect to the photosensitive member unit, and wherein (c) the first urging portion is non-enterable into the second hole.

According to a further aspect of the present invention, there is provided a process cartridge mountable to a main assembly of an electrophotographic image forming apparatus, along a longitudinal direction of the image forming apparatus, which includes a guide portion including a first hole and a second hole, a first urging portion provided to the first hole, and a second urging portion provided to the second hole, the process cartridge comprising:

a photosensitive member unit which includes an electrophotographic photosensitive member;

a developing unit which includes a developing roller for developing an electrostatic latent image formed on the electrophotographic photosensitive member and which is movable toward and away from the photosensitive member unit in order that the electrophotographic photosensitive member and the developing roller can be moved toward and away from each other;

a first portion to be urged provided on an upstream side with respect to a mounting direction of the process cartridge: and a second portion to be urged provided on a downstream side with respect to the mounting direction, wherein the first portion to be urged and the second portion to be urged are guided by the guide portion during mounting of the process cartridge in the main assembly, wherein in a state in which the process cartridge is mounted in the main assembly, the first portion to be urged enters the first hole and the second portion to be urged enters the second hole, wherein the first portion to be urged is urged by the first urging portion, in a state in which the first member to be urged enters the first hole, so as to move the developing unit with respect to the photosensitive member unit; and wherein the second portion to be urged is urged by the second urging portion, in a state in which the second member to be urged enters the second hole, so as to move the developing unit with respect to the photosensitive member unit, and wherein the second portion to be urged is non-enterable into the first hole.

According to a still further aspect of the present invention, there is provided a process cartridge mountable to a main assembly of an electrophotographic image forming apparatus, along a longitudinal direction of the image forming apparatus, which includes a first urging portion and a second urging portion, the process cartridge comprising:

a photosensitive member unit which includes an electrophotographic photosensitive member; and a developing unit which includes a developing roller for developing an electrostatic latent image formed on the electrophotographic photosensitive member and which is movable toward and away from the photosensitive member unit in order that the electrophotographic photosensitive member and the developing roller can be moved toward and away from each other;

wherein the developing unit comprises:

a portion to be guided for being guided by the first urging portion and the second urging portion during mounting of the process cartridge in the main assembly, wherein the portion to be guided includes a first hole, provided on an upstream side with respect to a mounting direction of the process cartridge, for permitting thereinto entry of the first urging portion in a state in which the process cartridge is mounted in the main assembly, and includes a second hole, provided on a downstream side with respect to the mounting direction, for permitting thereinto entry of the second urging portion in the state in which the process cartridge is mounted in the main assembly;

a first portion to be urged for being urged by the first urging portion, in a state in which the first member to be urged enters the first hole, so as to move the developing unit with respect to the photosensitive member unit; and a second portion to be urged for being urged by the second urging portion, in a state in which the second member to be urged enters the second hole, so as to move the developing unit with respect to the photosensitive member unit, and wherein the second hole is configured so that the first urging portion is non-enterable into the second hole.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment

The process cartridge and an electrophotographic color image forming apparatus (hereinafter referred to as an image forming apparatus) in Embodiment 1 of the present invention will be described with reference to the drawings.

(General Structure of Image Forming Apparatus)

Figure 1:
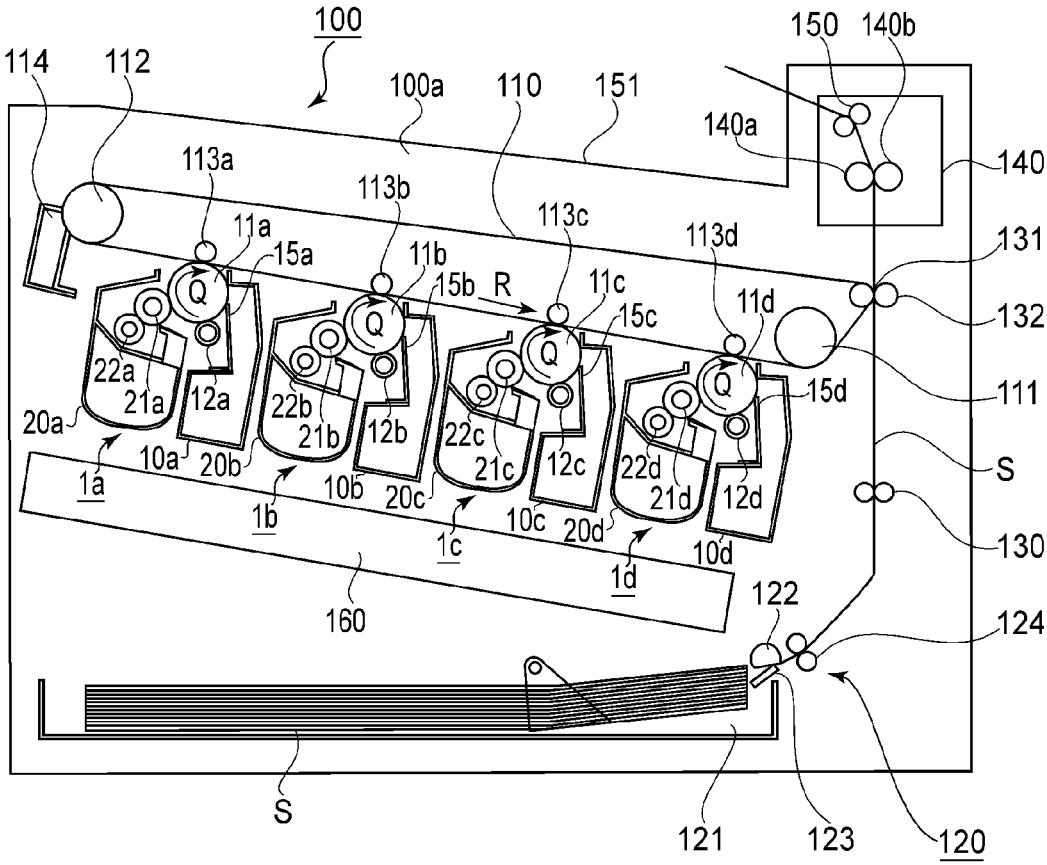
FIG. 1 is a sectional view of an image forming apparatus.

First, the general structure of the image forming apparatus will be described with reference to FIG. 1. An image forming apparatus 100 shown in FIG. 1 has four mounting portions 101 (101*a*-101*d*) (FIG. 5), as mounting means for four process cartridges, which are arranged and inclined with respect to a horizontal direction. The process cartridges 1 (1*a*-1*d*), which are mounted into the mounting portions 101, are provided with electrophotographic photosensitive drums 11 (11*a*, 11*b*, 11*c* and 11*d*), respectively.

The above-mentioned electrophotographic photosensitive drum (hereinafter referred to as photosensitive drum) 11 is rotationally driven in a direction indicated by an arrow Q in the figure by a driving member (unshown). Around each of the photosensitive drum 11, the following process means acting on the photosensitive drum 11 are disposed along its rotational direction in the order of a cleaning member 15 (15*a*, 15*b*, 15*c*, or 15*d*) for removing a developer remaining on the photosensitive drum 1 surface after transfer (hereinafter referred to as toner); a charging roller 12 (12*a*, 12*b*, 12*c*, or 12*d*) for uniformly charging the surface of the photosensitive drum 11; a developing unit 20 (20*a*, 20*b*, 20*c*, or 20*d*) for developing an electrostatic latent image with the toner; a scanner unit 160 for forming the electrostatic latent image on the surface of the photosensitive drum 11 by irradiation with a laser beam on the basis of image information; and an intermediary transfer belt 110 onto which four toner images formed on the photosensitive drums 11 are to be collectively transferred. The photosensitive drum 11, the cleaning member 15, the charge roller 12, and the developing unit 20 are integrally supported to constitute a process cartridge 1. The process cartridge 1 is detachably mountable to a main assembly 100*a* of the image forming apparatus 100 along a rotational axis (shaft) direction of the photosensitive drum 11 by a user.

The intermediary transfer belt 110 is stretched around a driving roller 111 and a tension roller 112. Inside the intermediary transfer belt 110, four primary transfer rollers 113 (113*a*-113*d*) are disposed oppositely to the photosensitive drums 11 (11*a*-11*d*). To the intermediary transfer belt 110, a transfer bias is applied by a bias applying means (unshown).

A toner image formed on each of the surface of the photosensitive drum 11 is successively primary-transferred onto the intermediary transfer belt 110 by rotation of the photosensitive drum 11 in the direction indicated by an arrow Q, rotation of the intermediary transfer belt 110 in the direction indicated by an arrow R, and by application of a positive bias to the primary transfer roller 113. Then, the four toner images in a superposed state on the intermediary transfer belt 110 are conveyed to the secondary transfer portion 131.

In synchronism with the above-mentioned image forming operation, a sheet S as the recording material is conveyed by a conveying means consisting of a sheet feeding device 120, a pair of registration rollers 130, etc. The sheet feeding device 120 has a sheet feeding cassette 121 for accommodating the sheet S, a sheet feeding roller 122 for feeding the sheet S, and a pair of sheet conveying rollers 124 for conveying the fed sheet S. The sheet feeding cassette 121 can be pulled out of the apparatus main assembly 100*a* in the frontward direction in FIG. 1. The sheet S is pressed against the sheet feeding roller 122 and is separated one by one by a separation pad 123 (one-side friction sheet separating method), thus being conveyed.

The sheet S conveyed from the sheet feeding device 120 is conveyed to the secondary transfer portion 131 by the pair of registration rollers 130. At the secondary transfer portion 131, the positive bias is applied to the secondary transfer roller 132. As a result, the four toner images on the intermediary transfer belt 110 are secondary-transferred onto the conveyed sheet S.

A fixing portion 140 as a fixing means fixes the toner images on the conveyed sheet S by applying heat and pressure to the toner images formed on the sheet S. A fixing belt 140*a* is cylindrical and is guided by a belt guide member (unshown) to which a heat generating means, such as a heater is bonded. The fixing belt 140*a* and the pressing roller 140*b*, form a fixing nip with a predetermined press-contact force.

The sheet S on which the unfixed toner images conveyed from the image forming portions is heated and pressed in the fixing nip. As a result, the unfixed toner images on the sheet S are fixed on the sheet S. Thereafter, the sheet S on which the toner images are fixed is discharged on a sheet discharge tray 151 by a pair of sheet discharge rollers 150.

The toner remaining on the surface of the photosensitive drum 11 after the toner image transfer is removed by the cleaning member 15 (15*a*-15*d*). The removed toner is collected in a removed toner chamber 16*a* in the photosensitive member unit 10 (10*a*-10*d*) shown in FIG. 2.

The toner remaining on the intermediary transfer belt 110 after the second transfer onto the sheet S is removed by a transfer belt cleaning device 114. The removed toner is conveyed through a waste toner conveyance passage (unshown), and is collected in a waste toner collecting container (unshown) located in the rear end portion of the apparatus.

(Process Cartridge)

Figure 2:
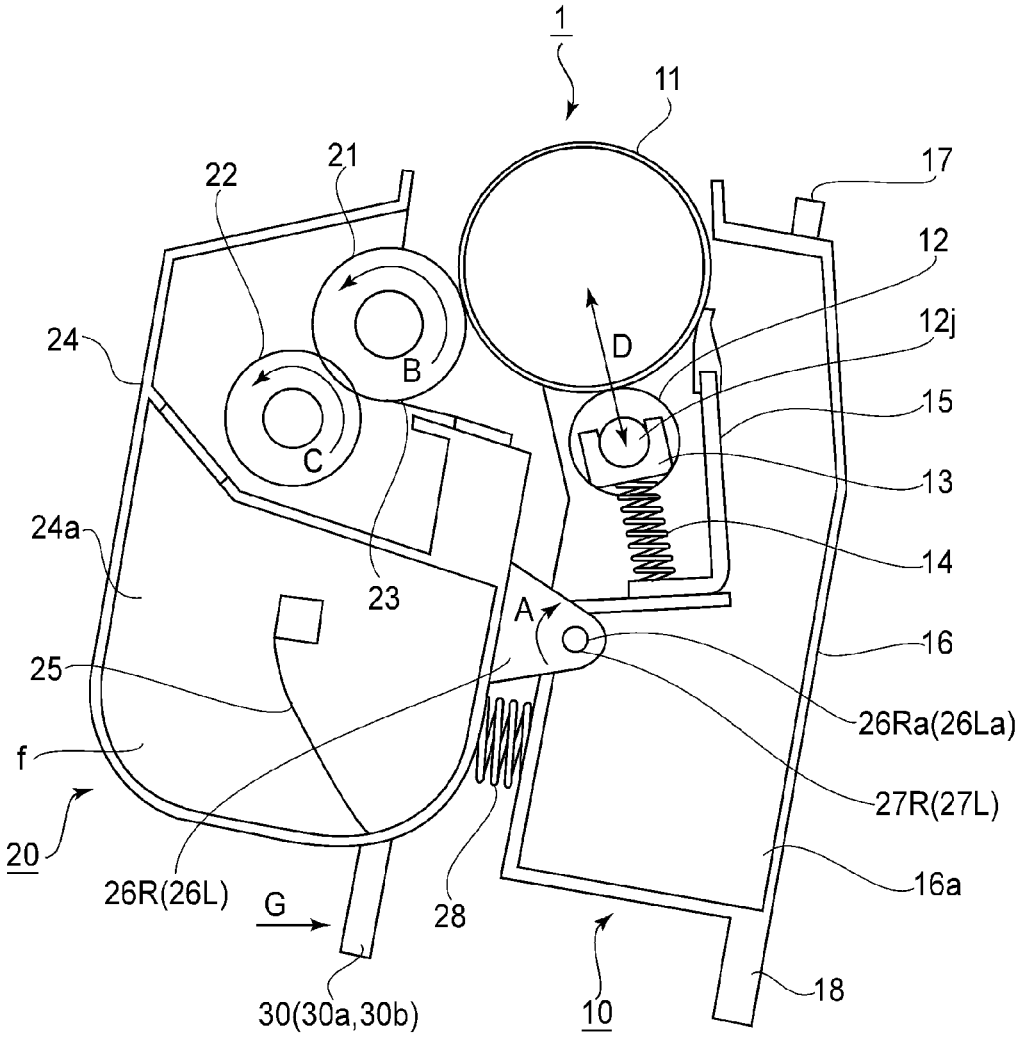
FIG. 2 is a sectional view of a principal portion of a process cartridge.

Next, the process cartridge 1 in this embodiment will be described with reference to FIG. 2. FIG. 2 is a principal sectional view of the process cartridge 1 containing toner t. Incidentally, the process cartridges 1*a*, 1*b*, 1*c*, and 1*d*, which contain yellow, magenta, cyan, and black toners t, respectively, have the same constitution.

Each process cartridge 1 is divided into a photosensitive member unit 10 and a developing unit 20. The photosensitive member unit 10 includes the photosensitive drum 11, charge roller 12 (charging means), and cleaning member 15 (cleaning means). The developing unit 20 includes a developing roller 21 as a developer carrying member. The photosensitive drum 11 is rotatably supported by a cleaning device frame 16 of the photosensitive member unit 10. The photosensitive drum 11 is rotationally driven correspondingly to the image forming operation by transmitting the driving force from a motor (unshown) to the photosensitive member unit 10.

The charge roller 12 and the cleaning member 15 are disposed on the peripheral surface of the photosensitive drum 11 as described previously. The residual toner removed from the surface of the photosensitive drum 11 by the cleaning member 15 falls into the removed toner chamber 16*a*. The cleaning device frame 16 is fitted with a pair of charging roller bearings 13, which are movable in the direction indicated by an arrow D, which passes through the centers of the charging roller 12 and the photosensitive drum 11. A shaft 12*j* of the charging roller 12 is rotatably supported by the pair of charging roller bearings 13. Further, the charging roller bearings 13 are kept pressed toward the photosensitive drum 11 by a charge roller pressing member 14.

The developing unit 20 has the developing roller 21 rotating in contact with the photosensitive drum 11 in the direction indicated by an arrow B, and has a developing device frame 24. The developing roller 21 is rotatably supported by the developing device frame 24 through shaft supporting member 26 (26R, 26L) attached to both longitudinal sides of the developing device frame 26. On the peripheral surface of the developing roller 21, a toner supplying roller 22 rotatable in contact with the developing roller 21 in the direction indicated by an arrow C, and a developing blade 23 for regulating in thickness the toner layer on the developing roller 21. Further, to a toner containing portion 24*a* of the developing device frame 24, a toner conveying member 25 for conveying the contained toner to the toner supplying roller 22 while stirring the toner is provided. The developing unit 20 is rotatably connected to the photosensitive member unit 10 about shafts 27 (27R and 27L) engageable with holes 26Rb and 26Lb provided in the shaft supporting members 26Rb and 26Lb. The developing unit 20 is urged by an urging spring 28. For that reason, during the image formation using the process cartridge 1, the developing unit 20 rotates about the shafts 27 in the direction indicated by an arrow A, so that the developing roller 21 contacts the photosensitive drum 11.

At a lower portion of the developing unit 20, a first portion to be urged 30*a* and a second portion to be urged 30*b* which are portion to be urged 30 for receiving an urging force from an urging portion 104, described later, of the image forming apparatus are provided.

These portions to be urged 30 receive an acting force with respect to a direction indicated by an arrow G to rotate the developing unit 20 about the shaft 27 in a direction opposite to the arrow A direction. As a result, the developing roller 21 and the photosensitive drum 11 are kept in a separated state.

(Contact and Separation Constitution)

Figure 3:
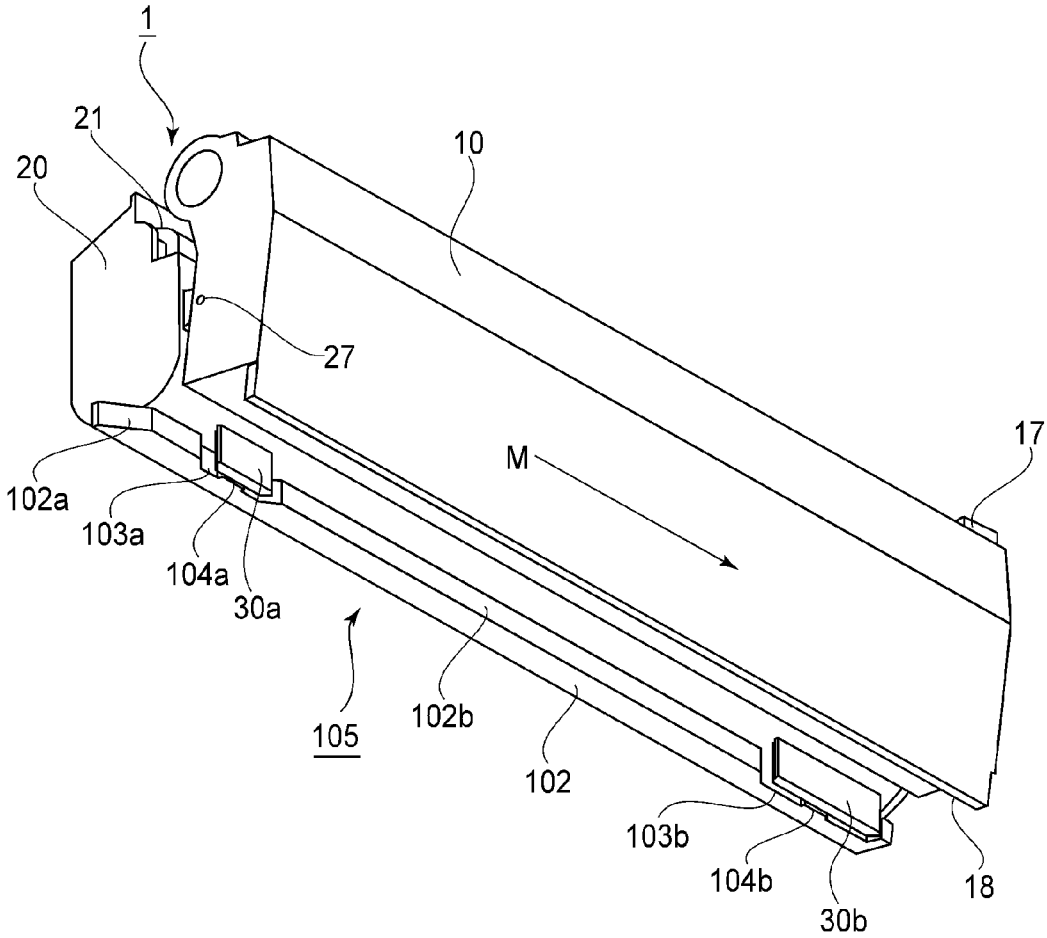
FIG. 3 is a schematic view of a developing device contact and separation mechanism and its peripheral portion.

Next, with reference to FIG. 3, a contact and separation constitution for contacting and separating the developing roller 21 and the photosensitive drum 11 in this embodiment will be described. FIG. 3 is a schematic view showing the portion to be urged 30, the urging portion 104, and their peripheral portions in a state in which the process cartridge 1 is mounted to the image forming apparatus 100.

At a lower portion of the process cartridge 1, the first portion to be urged 30*a* and the second portion to be urged 30*b* which are the portion to be urged 30 are provided. These first portion to be urged 30*a* and second portion to be urged 30*b* are provided at two longitudinal end portions of the process cartridge 1.

On the other hand, to the image forming apparatus 100, a developing device contact and separation mechanism 105 actable on the portion to be urged 30 of the process cartridge 1. The developing device contact and separation mechanism 105 is provided with a guide portion 102 along which the first portion to be urged 30*a* and the second portion to be urged 30*b* slide, during the mounting of the process cartridge 1, while guiding the first and second portions to be guided 30*a* and 30*b*. Further, the guide portion 102 is provided with a first hole 103*a* and a second hole 103*b* at two positions with respect to a longitudinal and mounting direction of the process cartridge 1. At the bottoms of the first hole 103*a* and the second hole 103*b*, a first urging portion 104*a* for urging the first portion to be urged 30*a* and a second urging portion 103*b* for urging the second portion to be urged 30*b* are provided, respectively. The developing device contact and separation mechanism 105 is configured so that the guide portion 102 and the first and second urging portions 104*a* and 104*b* can integrally move with respect to the process cartridge 1 while keeping a mutual positional relationship among the portions 102, 104*a* and 104*b*. Here, with respect to the mounting direction of the process cartridge 1, the first portion to be urged 30*a* and the first urging portion 104*a* are provided on an upstream side, and the second portion to be urged 30*b* and the second urging portion 104*b* are provided on a downstream side.

Further, the second portion to be urged 30*b* is configured to be larger (longer with respect to the process cartridge 1 mounting direction (indicated by an arrow M in FIG. 3) than the first portion to be urged 30*a*. ON the other hand, the first hole 103*a* and second hole 103*b* of the guide portion 102 are formed so as to be larger (longer) than the first portion to be urged 30*a* and the second portion to be urged 30*b*, respectively. Further, the second portion to be urged 30*b* is configured to be larger (longer) than the first portion to be urged 30*a*.

In this embodiment, by forming the portion to be urged 30 in a plate shape, a contact area when the portion to be urged 30 slides on the guide portion 102 is increased, so that a contact (surface) pressure received by the portion to be urged 30 can be reduced. Therefore, it is possible to reduce a degree of wearing (abrasion) of the portion to be urged 30 by the mounting operation of the process cartridge 1. Further, by providing the portion to be urged 30 at the two longitudinal portions, a variation in separation (spacing) amount in the longitudinal area caused due to torsion deformation of the process cartridge 1. Further, the first urging portion 104*a* and the second urging portion 104*b* are provided at the bottoms of the first hole 103*a* and the second hole 103*b*, so that the guide surface 102*b* of the guide portion 102 is higher than the first and second urging portions 104*a* and 104*b*. For this reason, the urging portion 104 is not subjected to sliding caused by mounting and demounting of the process cartridge 1, so that the urging portion 104 can be prevented from being worn.

The first portion to be urged 30*a* and the second portion to be urged 30*b* are configured to be able to enter the first hole 103*a* and the second hole 103*b*, respectively. In a state in which the mounting of the process cartridge 1 is completed, the first portion to be urged 30*a* and the second portion to be urged 30*b* contact the first urging portion 104*a* and the second urging portion 104*b* in a state in which the first portion to be urged 30*a* and the second portion to be urged 30*b* have entered the first hole 103*a* and the second hole 103*b*.

Figure 4:
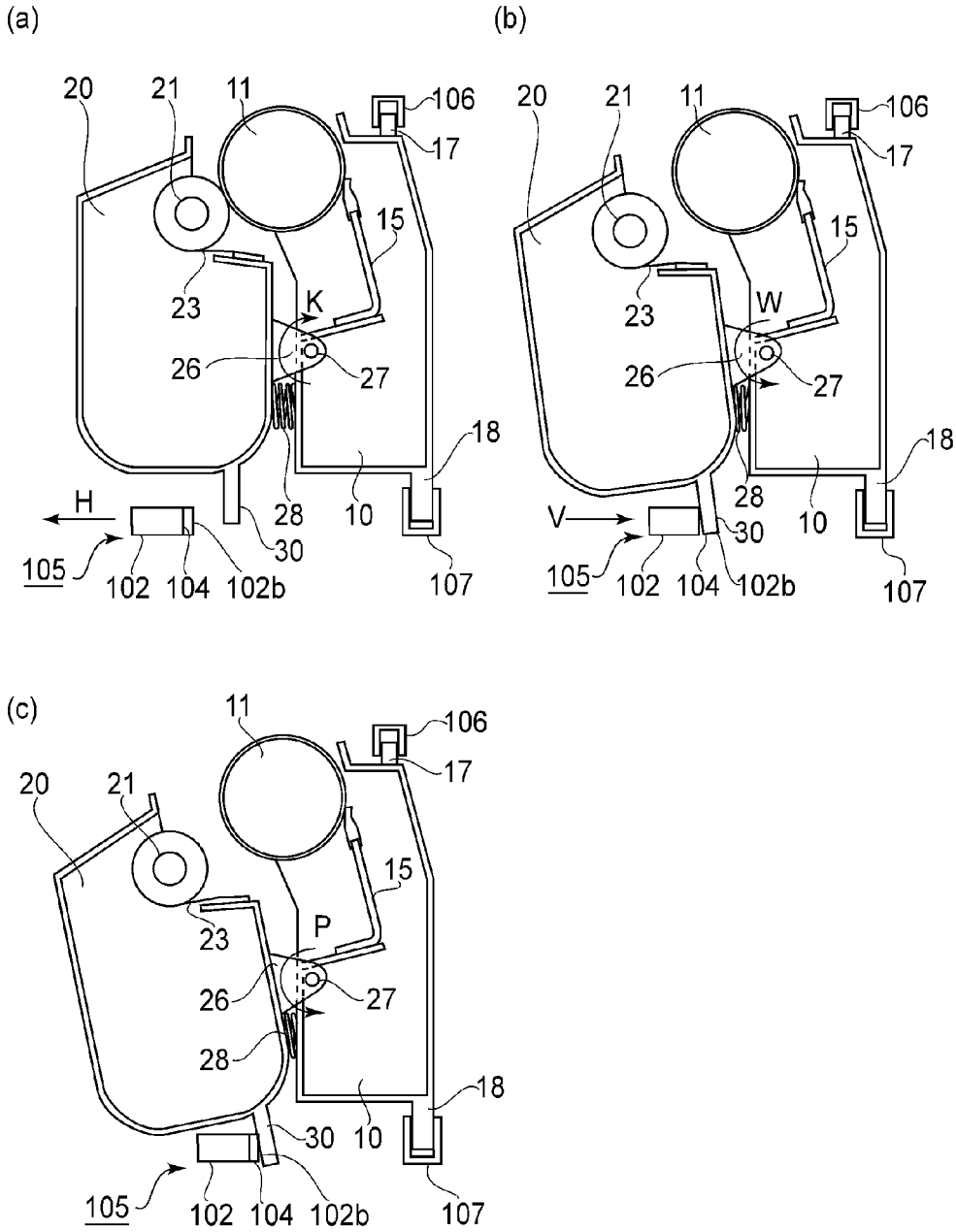
FIGS. 4(*a*) to 4(*c*) are schematic views for illustrating an operation for separating a developing device.

Next, an operation of the developing device contact and separation mechanism 105 will be described with reference to FIGS. 4(*a*) to 4(*c*).

During the image formation, the developing device contact and separation mechanism 105 receives a driving force from the image forming apparatus 100 and is retracted in a direction indicated by an arrow H. As a result, the force acting on the portion to be urged 30 of the developing unit 20 is released, so that the developing unit is rotated in a direction indicated by an arrow K with the shaft 27 as a supporting point. Then, the developing roller 21 contacts the photosensitive drum 11, so that a latent image on the surface of the photosensitive drum 11 is developed (FIG. 4(*a*)).

When the image forming operation is completed, the developing device contact and separation mechanism 105 moves in a direction indicated by an arrow V to approach the portion to be urged 30 again. In this state, the first and second urging portions 104 (104*a*, 104*b*) are configured so that when the portion to be urged 30 of the process cartridge 1 contacts an associated one of the first and second urging portions 104, the developing roller 21 is moved away from the photosensitive drum 11. That is, the developing unit 20 is rotated in a direction indicated by an arrow W with the shaft 27 as the supporting point by contact of the portion to be urged 30 with the urging portion 104. Then, the developing roller 21 is moved away from the photosensitive drum 11 (FIG. 4(*b*)).

During the mounting of the process cartridge 1 and during stand-by other than the image formation, the developing device contact and separation mechanism 105 is controlled so as to be stopped at a position in which the developing roller 21 is moved away from the photosensitive drum 11.

On the other hand, the guide surface 102*b* of the guide portion 102 is configured so that the developing roller 21 is moved away from the photosensitive drum 11 when the guide surface 102*b* contacts the portion to be urged 30. When the process cartridge 1 is mounted and demounted, the developing unit 20 is rotated in a direction indicated by an arrow P with the shaft as the supporting point by contact of the guide surface 102*b* of the guide portion 102 with the portion to be urged 30 of the process cartridge 1. Then, the developing roller 21 is moved away from the photosensitive drum 11 (FIG. 4(*c*)).

Thus, during the mounting operation of the process cartridge 1, it is possible to move the developing unit 20 away from the photosensitive member unit 10. Therefore, even in a state in which the process cartridge 1 is left standing for a long time in the image forming apparatus 100, the developing roller 21 is kept in the separated state with respect to the photosensitive drum 11.

(Mounting of Process Cartridge to Image Forming Apparatus).

Figure 5:
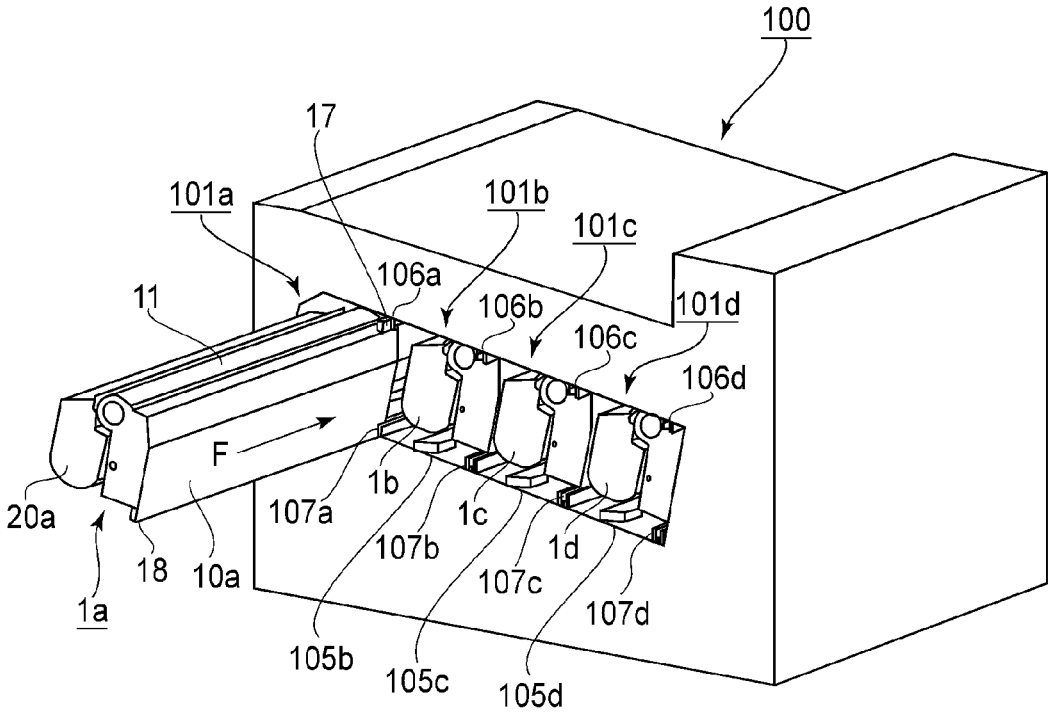
FIG. 5 is a schematic view for illustrating mounting of the process cartridge to the image forming apparatus.

Next, with reference to FIGS. 4(*a*) to 4(*c*) and FIG. 5, the mounting operation of the process cartridge 1 to the image forming apparatus 100 will be described.

To the image forming apparatus 100, the process cartridge 1 is mountable with respect to a rotational axis direction (indicated by an arrow F in FIG. 5) of the photosensitive drum 11. At upper portion and lower portion of the photosensitive member unit 10 of the process cartridge 1, an upper guide 17 and a lower guide 18 are provided, respectively. On the other hand, to mounting portions 101 (101*a*-101*d*), upper mounting rails 106 (106*a*-106*d*) for guiding the upper guide 17 and lower mounting rails 107 (107*a*-107*d*) are provided.

When the process cartridge 1 is mounted to the image forming apparatus 100, the upper guide 17 and lower guide 18 of the photosensitive member unit 10 are guided and inserted by the upper mounting rail 106 and the lower mounting rail 107, respectively.

Next, with reference to FIGS. 6(*a*) to 6(*d*), a contact relationship between the portion to be urged 30 of the developing unit 20 and the developing device contact and separation mechanism 105 of the image forming apparatus 100 during the mounting of the process cartridge 1 will be described.

Figure 6:
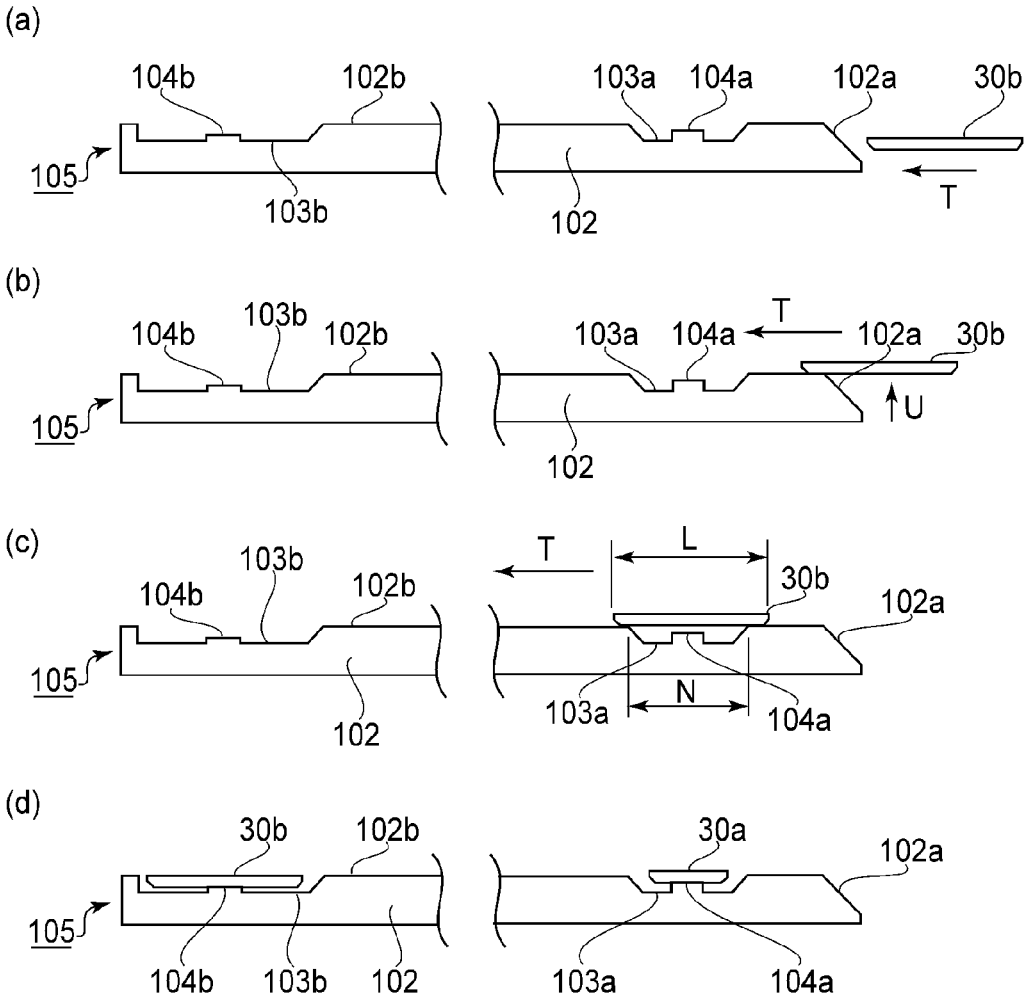
FIGS. 6(*a*) to 6(*d*) are detailed views showing a portion to be urged in a mounting process.

The process cartridge 1 is mounted to the image forming apparatus 100 with respect to a direction indicated by an arrow T shown in FIGS. 6(*a*) to 6(*c*).

The guide portion 102, of the image forming apparatus 100, capable to the portion to be urged 30 of the developing unit 20 is provided with the tapered portion 102*a* on a front side of a mounting direction of the process cartridge 1 (FIG. 6(*a*)).

When the process cartridge 1 is inserted into the image forming apparatus 100, the second portion to be urged 30*b* of the developing unit 20 contacts the tapered portion 102*b*. When the process cartridge 1 is inserted further into the image forming apparatus 100, the second portion to be urged 30*b* is subjected to an acting force, with respect to a direction indicated by an arrow U, along the tapered portion 102*a* to be moved to the guide surface 102*b* (FIG. 6(*b*)). As a result, as described above, the photosensitive drum 11 and the developing roller 21 are placed in the separated state.

When the process cartridge 1 is still further inserted into the image forming apparatus 100, the second portion to be urged 30 is inserted into a position where the first hole 103*a* of the guide portion 102 is provided. At this time, a width L of the second portion to be urged 30*b* is larger than a width N of the first hole 103*a* of the guide portion 102, so that the second portion to be urged 30*b* passes over the first hole 103*a* along the guide surface 102*b* without entering the first hole 103 (FIG. 6(*c*)).

Then, in a state in which the mounting of the process cartridge 1 to the image forming apparatus 100 is completed, the first portion to be urged 30*a* and the second portion to be urged 30*b* are inserted into positions of the first hole 103*a* and the second hole 103*b*, respectively. Then, as described above, the developing unit 20 is rotated about the shaft 27 in a contact direction by the urging force of the urging spring 28, so that the portion to be urged 30 abuts against the urging portion 104 and is held by the urging portion 104 (FIG. 6(*d*)). At this time, the photosensitive drum 11 and the developing roller 21 are separated from each other by the abutment between the portion to be urged 30 and the urging portion 104.

As described above, in the mounting process of the process cartridge 1, by the constitution in which the second portion to be urged 30*b* is wider than the first hole 103*a*, the second portion to be urged 30*b* is non-enterable into the first hole 103*a*. Therefore, an insertion load of the process cartridge 1 is not changed during the insertion, so that a mounting property of the process cartridge 1 can be improved. That is, according to this embodiment, during the mounting process of the process cartridge 1 in which the developing roller is movable toward and away from the electrophotographic photosensitive member, a degree of fluctuation in mounting force of the process cartridge can be reduced. As a result, the mounting force of the process cartridge is kept at a constant level, so that the mounting property can be improved.

In this embodiment, a length (width) of the process cartridge 1 with respect to the mounting direction of the process cartridge 1 is adjusted but an adjusting method is not limited thereto so long as the second portion to be urged 30*b* is configured so as not to enter the first hole 103*a*. That is, a length of the process cartridge 1 with respect to a direction perpendicular to the mounting direction may also be adjusted.

Incidentally, in this embodiment, the description is made with respect to the case where the guide portion 102 includes the urging portion 104 (the case where the guide portion 102 is provided integrally with the urging portion 104) but the urging portion 104 may also be provided as a separate member.

Figure 7:
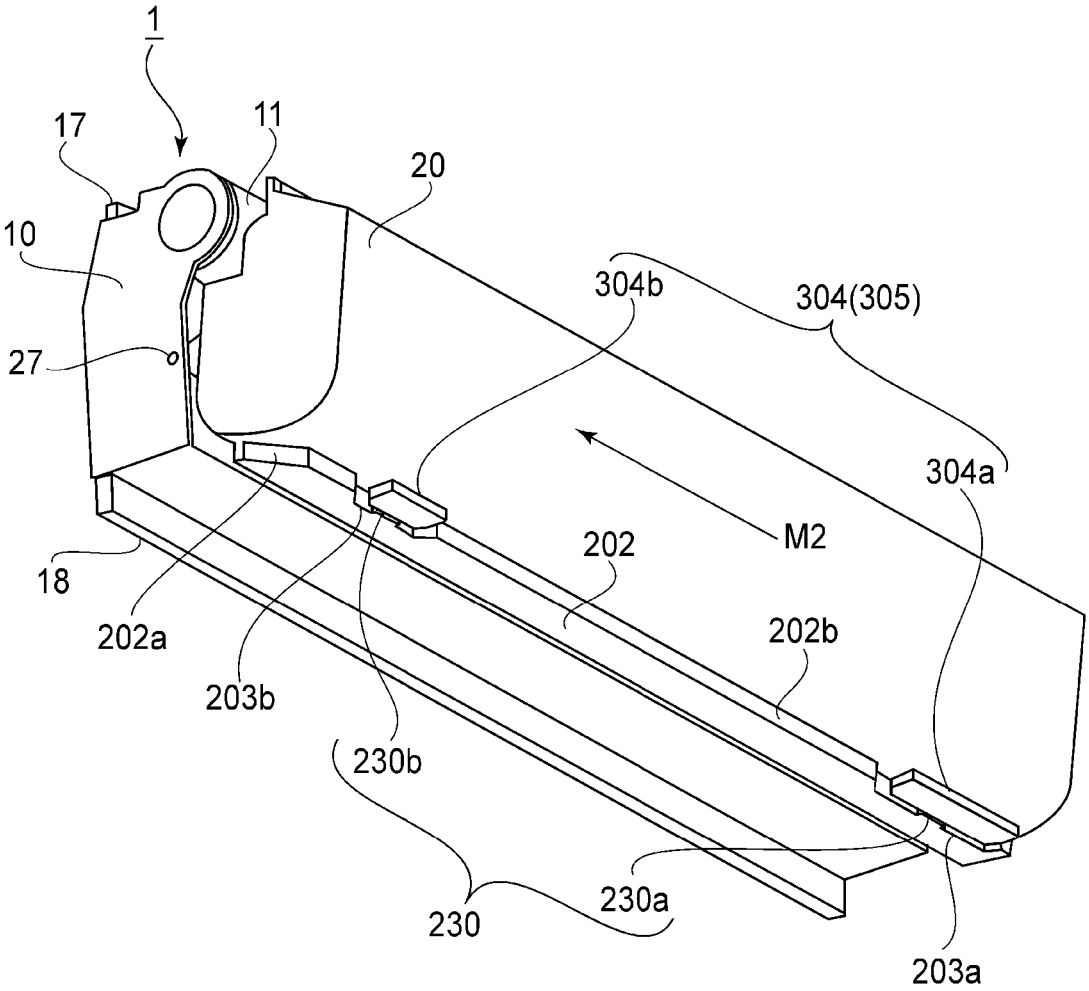
FIG. 7 is a schematic view showing a developing device contact and separation mechanism and its peripheral portion in Embodiment 2.

Next, with reference to FIG. 7, a developing device contact and separation constitution in this embodiment will be described. FIG. 7 is a schematic view showing a portion to be urged 230, a developing device contact and separation mechanism 305, and their peripheral portions in a state in which the process cartridge 1 is mounted to the image forming apparatus 100.

At a lower portion of the process cartridge 1, a portion to be guided 202 for being guided by an urging portion 304 of the image forming apparatus 100 described later while sliding on the urging portion 304 is provided. Further, the portion to be guided 202 is provided with a first hole 203*a* and a second hole 203*b* at two portions with respect to the longitudinal and mounting direction of the process cartridge 1. At the bottoms of the first hole 203*a* and the second hole 203*b*, a first portion to be urged 230 a and a second portion to be urged 230*b* which are the portion to be urged 230 are provided, respectively.

On the other hand, to the image forming apparatus 100, the developing device contact and separation mechanism 305 provided with the urging portion 304 actable on the portion to be urged 302 of the process cartridge 1. The developing device contact and separation mechanism 305 is provided with a first urging portion 304*a* actable on the first portion to be urged 230*a* and a second urging portion 103*b* for urging the second portion to be urged 30*b* are provided, respectively. The developing device contact and separation mechanism 305 is configured so that the guide portion 102 and the first and second urging portions 204*a* and 204*b* can integrally move with respect to the process cartridge 1 while keeping a mutual positional relationship between the urging portions, 204*a* and 204*b*. Here, with respect to the mounting direction of the process cartridge 1, the first portion to be urged 230*a* and the first urging portion 304*a* are provided on an upstream side, and the second portion to be urged 230*b* and the second urging portion 304*b* are provided on a downstream side.

Further, the first urging portion 304*a* is configured to be larger than the first portion to be urged 30*a* with respect to the process cartridge 1 mounting direction (indicated by an arrow M2 in FIG. 7). On the other hand, the first hole 203*a* and second hole 203*b* of the portion to be guided 202 are formed so as to be longer than the first urging portion 304*a* and the second urging portion 304*b*, respectively. Further, the first urging portion 304*a* is configured to be longer than the second hole 203*b*. In this embodiment, by providing the portion to be urged 230 at the two longitudinal portions, a variation in separation (spacing) amount in the longitudinal area caused due to torsion deformation of the process cartridge 1. Further, the first portion to be urged 230*a* and the second portion to be urged 230*b* are provided at the bottoms of the first hole 103*a* and the second hole 203*b*, so that a guide surface 202*b* of the portion to be guided 202 is higher than the first and second portions to be urged 230*a* and 230*b*. For this reason, the portion to be urged 204 is not subjected to sliding caused by mounting and demounting of the process cartridge 1, so that the urging portion 104 can be prevented from being worn.

The first urging portion 304*a* and the second urging portion 304*b* are configured to be able to enter the first hole 203*a* and the second hole 203*b*, respectively. In a state in which the mounting of the process cartridge 1 is completed, the first urging portion 304*a* and the second urging portion 304*b* contact the first portion to be urged 230*a* and the second portion to be urged 230*b* in a state in which the first urging portion 304 and the second urging portion 304*b* have entered the first hole 203*a* and the second hole 203*b*.

Next, with reference to FIGS. 8(*a*) to 8(*d*), a contact relationship between the portion to be urged 230 of the developing unit 20 and the urging portion 304 of the image forming apparatus 100 during the mounting of the process cartridge 1 will be described.

Figure 8:
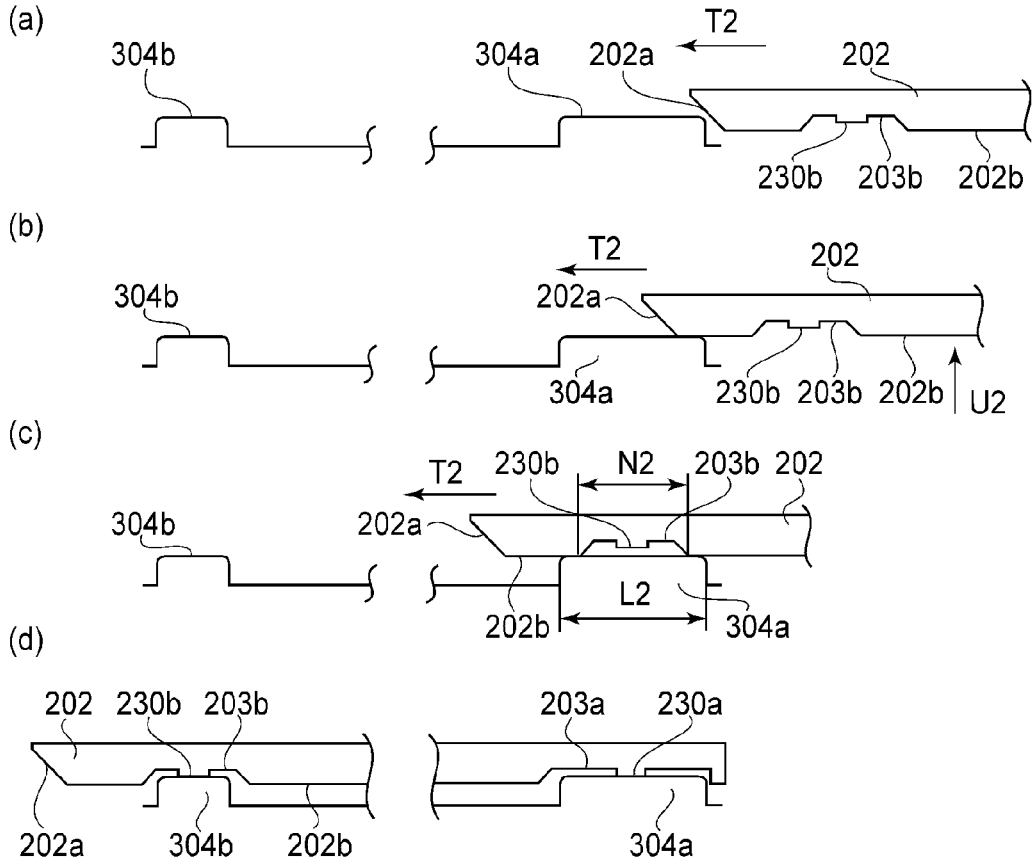
FIGS. 8(*a*) to 8(*d*) are detailed views showing a portion to be urged in a mounting process in Embodiment 2.
Figure 9:
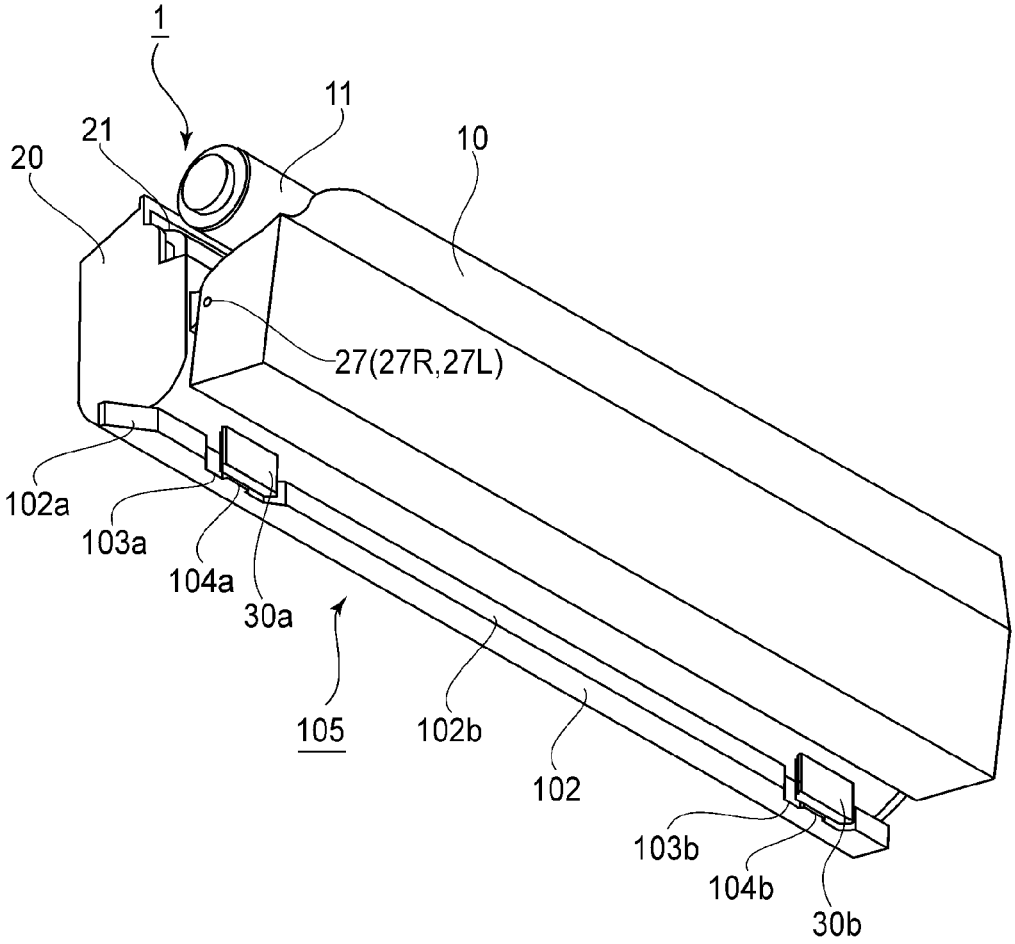
FIG. 9 is a schematic view showing a constitution of a conventional developing device separation portion.
Figure 10:
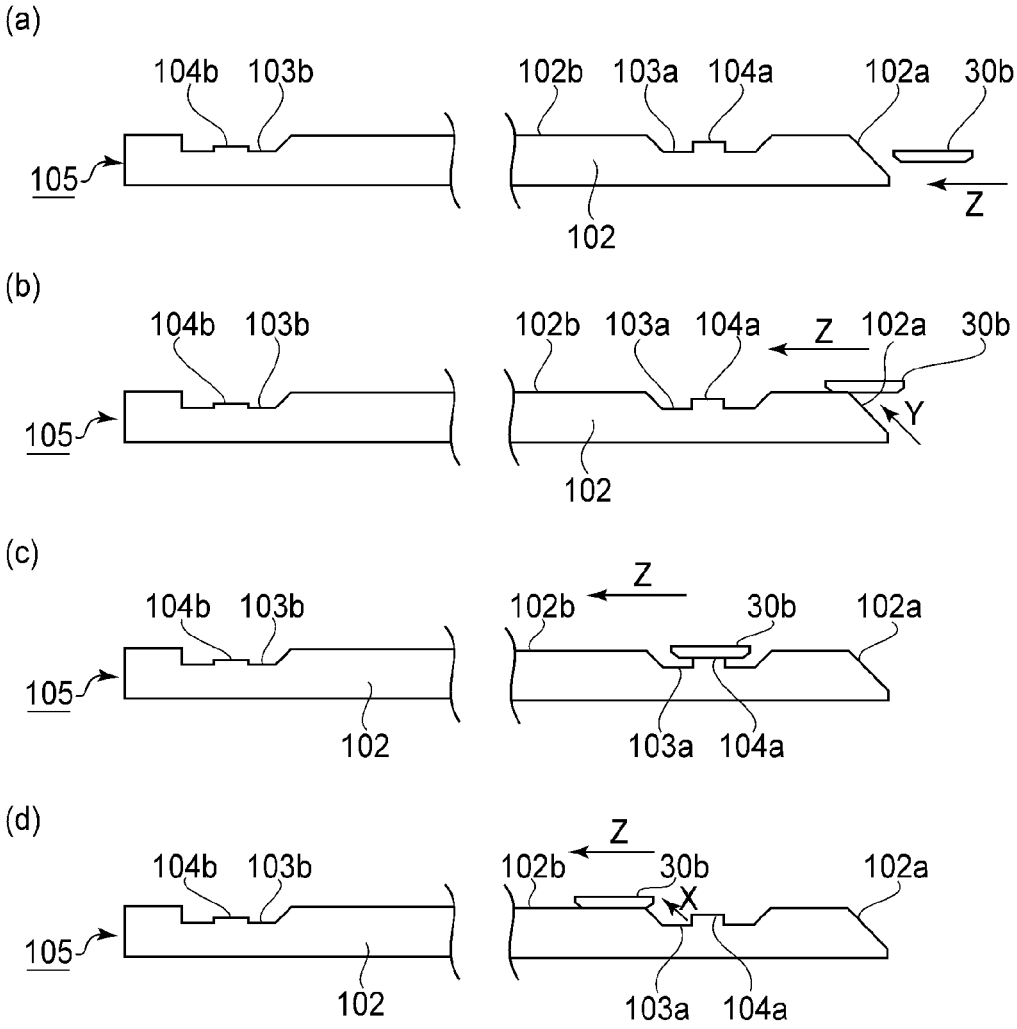
FIGS. 10(*a*) to 10(*d*) are detailed views showing the developing device separation portion in a conventional mounting process.

The process cartridge 1 is mounted to the image forming apparatus 100 with respect to a direction indicated by an arrow T2 shown in FIGS. 8(*a*) to 8(*c*).

The portion to be guided 202, of the process cartridge 1, capable to the urging portion 304 of the image forming apparatus 100 is provided with a tapered portion 202*a* on a rear side of a mounting direction of the process cartridge 1 (FIG. 8(*a*)).

When the process cartridge 1 is inserted into the image forming apparatus 100, the tapered portion 202*b* contacts the first urging portion 304*a* of the image forming apparatus 100. When the process cartridge 1 is inserted further into the image forming apparatus 100, the portion to be guided 202 of the developing unit 20 is subjected to an acting force, with respect to a direction indicated by an arrow U2. As a result, the guide surface 202*b* is moved to a position in which the guide surface 202*b* contacts the first urging portion 304*a* (FIG. 8(*b*)). As a result, as described in Embodiment 1, the photosensitive drum 11 and the developing roller 21 are placed in the separated state.

When the process cartridge 1 is still further inserted into the image forming apparatus 100, the second hole 203*b* of the portion to be guided 202 is inserted into a position of the first urging portion 304*a*. At this time, a width L2 of the second first urging portion 304*a* is larger than a width N2 of the second hole 203*b* of the portion to be guided 202, so that the second hole 203*b* passes over the first urging portion 304*a* with no entrance of the first urging portion 304*a* into the second hole 203*b* (FIG. 8(*c*)).

Then, in a state in which the mounting of the process cartridge 1 to the image forming apparatus 100 is completed, the first hole 203*a* and the second hole 203*b* are inserted into positions of the first urging portion 304*a* and the second urging portion 304*b*, respectively. Then, as described in Embodiment 1, the developing unit 20 is rotated about the shaft 27 in a contact direction by the urging force of the urging spring 28, so that the portion to be urged 230 abuts against the urging portion 304 and is held by the urging portion 304 (FIG. 8(*d*)). At this time, the photosensitive drum 11 and the developing roller 21 are separated from each other by the abutment between the portion to be urged 230 and the urging portion 304.

As described above, in the mounting process of the process cartridge 1, by the constitution in which the first urging portion 304*a* is wider than the second hole 203*a*, the first urging portion 304*a* is non-enterable into the second hole 203*b*. Therefore, an insertion load of the process cartridge 1 is not changed during the insertion, so that a mounting property of the process cartridge 1 can be improved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 032821/2009 filed Feb. 16, 2009, which is hereby incorporated by reference.

What is claimed is:

1. An electrophotographic image forming apparatus comprising:

a process cartridge comprising a photosensitive member unit which includes an electrophotographic photosensitive member and comprising a developing unit which includes a developing roller for developing an electrostatic latent image formed on the electrophotographic photosensitive member and which is movable toward and away from the photosensitive member unit in order that the electrophotographic photosensitive member and the developing roller can be moved toward and away from each other; and a main assembly of said electrophotographic image forming apparatus to which said process cartridge is mountable along a longitudinal direction of said electrophotographic photosensitive member, wherein (a) the developing unit includes a first portion to be urged provided on an upstream side with respect to a mounting direction of said process cartridge and includes a second portion to be urged provided on a downstream side with respect to the mounting direction, wherein (b) said main assembly comprises:

a guide portion for guiding the first portion to be urged and the second portion to be urged during mounting of said process cartridge in said main assembly, wherein the guide portion includes, in a state in which said process cartridge is mounted in said main assembly, a first hole for permitting thereinto entry of the first portion to be urged and a second hole for permitting thereinto entry of the second portion to be urged;

a first urging portion for urging the first portion to be urged, in a state in which the first portion to be urged enters the first hole, so as to move the developing unit with respect to the photosensitive member unit; and a second urging portion for urging the second portion to be urged, in a state in which the second portion to be urged enters the second hole, so as to move the developing unit with respect to the photosensitive member unit, and wherein (c) the second portion to be urged is non-enterable into the first hole.

2. An apparatus according to claim 1, wherein the second portion to be urged has a width larger than a width of the first hole with respect to the mounting direction.

3. An electrophotographic image forming apparatus comprising:

a process cartridge comprising a photosensitive member unit which includes an electrophotographic photosensitive member and comprising a developing unit which includes a developing roller for developing an electrostatic latent image formed on the electrophotographic photosensitive member and which is movable toward and away from the photosensitive member unit in order that the electrophotographic photosensitive member and the developing roller can be moved toward and away from each other; and a main assembly of said electrophotographic image forming apparatus to which said process cartridge is mountable along a longitudinal direction of said electrophotographic photosensitive member, wherein (a) said main assembly includes a first urging portion provided on an upstream side with respect to a mounting direction of said process cartridge and includes a second urging portion provided on a downstream side with respect to the mounting direction, wherein (b) the developing unit comprises:

a portion to be guided for being guided by the first urging portion and the second urging portion during mounting of said process cartridge in said main assembly, wherein the portion to be guided includes, in a state in which said process cartridge is mounted in said main assembly, a first hole for permitting thereinto entry of the first urging portion and a second hole for permitting thereinto entry of the second urging portion;

a first portion to be urged for being urged by the first urging portion, in a state in which the first portion to be urged enters the first hole, so as to move the developing unit with respect to the photosensitive member unit; and a second portion to be urged for being urged by the second urging portion, in a state in which the second portion to be urged enters the second hole, so as to move the developing unit with respect to the photosensitive member unit, and wherein (c) the first urging portion is non-enterable into the second hole.

4. An apparatus according to claim 3, wherein the first urging portion has a width larger than a width of the second hole with respect to the mounting direction.

5. A process cartridge mountable to a main assembly of an electrophotographic image forming apparatus, along a longitudinal direction of the image forming apparatus, which includes a guide portion including a first hole and a second hole, a first urging portion provided to the first hole, and a second urging portion provided to the second hole, said process cartridge comprising:

a photosensitive member unit which includes an electrophotographic photosensitive member;

a developing unit which includes a developing roller for developing an electrostatic latent image formed on the electrophotographic photosensitive member and which is movable toward and away from said photosensitive member unit in order that the electrophotographic photosensitive member and the developing roller can be moved toward and away from each other;

a first portion to be urged provided on an upstream side with respect to a mounting direction of said process cartridge: and a second portion to be urged provided on a downstream side with respect to the mounting direction, wherein the first portion to be urged and the second portion to be urged are guided by the guide portion during mounting of said process cartridge in the main assembly, wherein in a state in which said process cartridge is mounted in the main assembly, said first portion to be urged enters the first hole and said second portion to be urged enters the second hole, wherein the first portion to be urged is urged by the first urging portion, in a state in which said first portion to be urged enters the first hole, so as to move the developing unit with respect to the photosensitive member unit; and wherein the second portion to be urged is urged by the second urging portion, in a state in which said second portion to be urged enters the second hole, so as to move said developing unit with respect to said photosensitive member unit, and wherein said second portion to be urged is non-enterable into the first hole.

6. A cartridge according to claim 5, wherein said second portion to be urged has a width larger than a width of the first hole with respect to the mounting direction.

7. A process cartridge mountable to a main assembly of an electrophotographic image forming apparatus, along a longitudinal direction of the image forming apparatus, which includes a first urging portion and a second urging portion, said process cartridge comprising:

a photosensitive member unit which includes an electrophotographic photosensitive member; and a developing unit which includes a developing roller for developing an electrostatic latent image formed on the electrophotographic photosensitive member and which is movable toward and away from said photosensitive member unit in order that the electrophotographic photosensitive member and the developing roller can be moved toward and away from each other;

wherein said developing unit comprises:

a portion to be guided for being guided by the first urging portion and the second urging portion during mounting of said process cartridge in the main assembly, wherein the portion to be guided includes a first hole, provided on an upstream side with respect to a mounting direction of said process cartridge, for permitting thereinto entry of the first urging portion in a state in which said process cartridge is mounted in the main assembly, and includes a second hole, provided on a downstream side with respect to the mounting direction, for permitting thereinto entry of the second urging portion in the state in which said process cartridge is mounted in the main assembly;

a first portion to be urged for being urged by the first urging portion, in a state in which the first portion to be urged enters the first hole, so as to move said developing unit with respect to said photosensitive member unit; and a second portion to be urged for being urged by the second urging portion, in a state in which the second portion to be urged enters the second hole, so as to move said developing unit with respect to said photosensitive member unit, and wherein the second hole is configured so that the first urging portion is non-enterable into the second hole.

8. A cartridge according to claim 7, wherein the second hole has a width smaller than a width of the first urging portion with respect to the mounting direction.

* * * * *